US005429576A

United States Patent [19]

Doderer-Winkler

[11] Patent Number: 5,429,576

[45] Date of Patent: Jul. 4, 1995

[54] APPARATUS FOR MAKING REUSABLE ADHESIVE ENVELOPES

[75] Inventor: Alfred Doderer-Winkler, Melsbach, Germany

[73] Assignee: Winkler & Dunnebier, Neuwied, Germany

[21] Appl. No.: 277,594

[22] Filed: Jul. 20, 1994

Related U.S. Application Data

[62] Division of Ser. No. 224,692, Apr. 8, 1994.

[51] Int. Cl.[6] ..... B31B 3/90; B31B 1/72

[52] U.S. Cl. ..... 493/214; 493/923; 156/517; 156/521; 156/542

[58] Field of Search ..... 493/211, 213, 214, 923; 156/517, 521, 542

[56] References Cited

U.S. PATENT DOCUMENTS

| | | | |
|---|---|---|---|
| Re. 33,173 | 2/1990 | Cassey | 493/195 |
| 4,738,391 | 4/1988 | Wiseman | 229/80 |
| 5,095,683 | 3/1992 | Roberts et al. | 53/413 |
| 5,176,611 | 1/1993 | VerMehren | 493/213 |
| 5,200,020 | 4/1993 | Collins et al. | 156/520 |
| 5,221,567 | 6/1993 | Baker | 428/43 |

FOREIGN PATENT DOCUMENTS

| | | | |
|---|---|---|---|
| 878245 | 8/1971 | Canada | 493/213 |

*Primary Examiner*—William E. Terrell

*Attorney, Agent, or Firm*—Kokjer, Kircher, Bowman & Johnson

[57] ABSTRACT

A reusable adhesive envelope and a method and apparatus for making same. The envelope includes a pouch adapted to receive the contents and having an open edge. A flap is mounted adjacent this open edge and may be folded about a flap fold to close the pouch opening. The exterior of the pouch mounts a protective strip. The interior face of the flap mounts a pressure sensitive adhesive, which is initially covered by a release liner. Upon removing the release liner the adhesive on the flap may be secure to the protective strip to close the flap. The flap may be opened and reclosed numerous times. The protective strip and the adhesive/release liner combination are each applied to the envelope as tape strips. With the envelopes in the open configuration these tape strips are alternately applied from a single transfer mechanism.

5 Claims, 1 Drawing Sheet

APPARATUS FOR MAKING REUSABLE ADHESIVE ENVELOPES

This is a Divisional of pending application Ser. No. 08/224,692, filed Apr. 8, 1994.

BACKGROUND OF THE INVENTION

1. Field of the Invention

The present invention relates in general to envelopes, especially those having pressure sensitive adhesive flaps. In particular, the present invention relates to an improved envelope having a reusable adhesive flap, and a method and apparatus for making same.

2. Description of the Related Art

Typical envelope configurations include a pouch section adapted to receive the contents of the envelope, and a flap located at the opening of the pouch and adapted to be folded over and secured to the exterior of the pouch. While it has been known for some time to provide the flap with an adhesive, in recent years it has become increasingly common to provide a pressure sensitive adhesive, so that moistening of the adhesive is not required.

Certain envelope types, such as those intended for interoffice communications, are used numerous times before being discarded. Such envelopes have been known to be provided with a string-and-post closure arrangement to secure the flap in the closed position. With the increased use of pressure sensitive adhesive seals, it has been desired to provide interoffice-type reusable envelopes having adhesive flaps. To permit this, however, it is often desirable to provide the pouch exterior with a protective area to which the adhesive will adhere. Such a protective area will help to ensure the pouch body material does not delaminate and destroy the envelope, and/or the fibers from the pouch body will not build up on tile adhesive to reduce its bond strength.

One commercially available envelope of this type employs a protective strip in the form of a first adhesive tape adhesively secured to the exterior of the pouch. The flap includes a large aperture, and a length of a second adhesive tape is secure to the exterior of the flap, over the aperture. The portion of the second adhesive tape within the aperture may then be secured to the protective strip upon closing the flap. The protective strip has a stronger bond to the pouch than to the adhesive tape, and as such the tape may be removed from the protective strip to allow the envelope to be opened and reclosed many times.

While this arrangement is serviceable, it does have several drawbacks. First, the envelope blank must undergo a separate step to form the aperture in the flap. Second, the protective strip and adhesive tape must be applied in two separate steps, with folding of the flap taking place between these steps. Finally, the flap is secured in the closed position during manufacture. As such, the user must break the adhesive seal prior to the first use of the envelope, reducing user confidence in the seal.

It has also been known to place a strip of adhesive tape upon the interior of the flap, with the adhesive tape being initially covered by a release layer. This arrangement prevents the flaps from sticking to other envelopes, provides a strong initial seal, and avoids the need to close the flap to add the flap tape. However, these strips of tape are applied parallel to the flap fold. In most envelope forming processes the envelopes are transported perpendicular to the flap fold. As such, these adhesive tapes must be applied as a separate step by a separate machine.

SUMMARY OF THE INVENTION

An object of the present invention is to provide a reusable adhesive envelope.

Another object of the present invention is to provide such an envelope having a protective strip secured to the envelope pouch and an adhesive on the interior of the envelope flap, which adhesive is initially covered by a removable release liner.

Another object of the present invention is to provide a method and apparatus for forming such an envelope.

A further object of the present invention is to provide such a method and apparatus which may be easily integrated into a typical envelope forming device.

Yet another object of the present invention is to provide such a method and apparatus which allows the protective strip and flap adhesive to be applied while transporting the envelope in a direction perpendicular to the flap fold line.

Yet another object of the present invention is to provide such a method and apparatus which operates with rotary motion, with very little, if any indexing of components.

These and other objects are achieved by a reusable adhesive envelope and a method and apparatus for making same. The envelope includes a pouch adapted to receive the contents and having an open edge. A flap is mounted adjacent this open edge and may be folded about a flap fold to close the pouch opening. The exterior of the pouch mounts a protective strip. The interior face of the flap mounts a pressure sensitive adhesive, which is initially covered by a release liner. Upon removing the release liner the adhesive on the flap may be secure to the protective strip to close the flap. The flap may be opened and reclosed numerous times. The protective strip and the adhesive/release liner combination are each applied to the envelope as tape strips. With the envelopes in the open configuration these tape strips are alternately applied from a single transfer mechanism.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
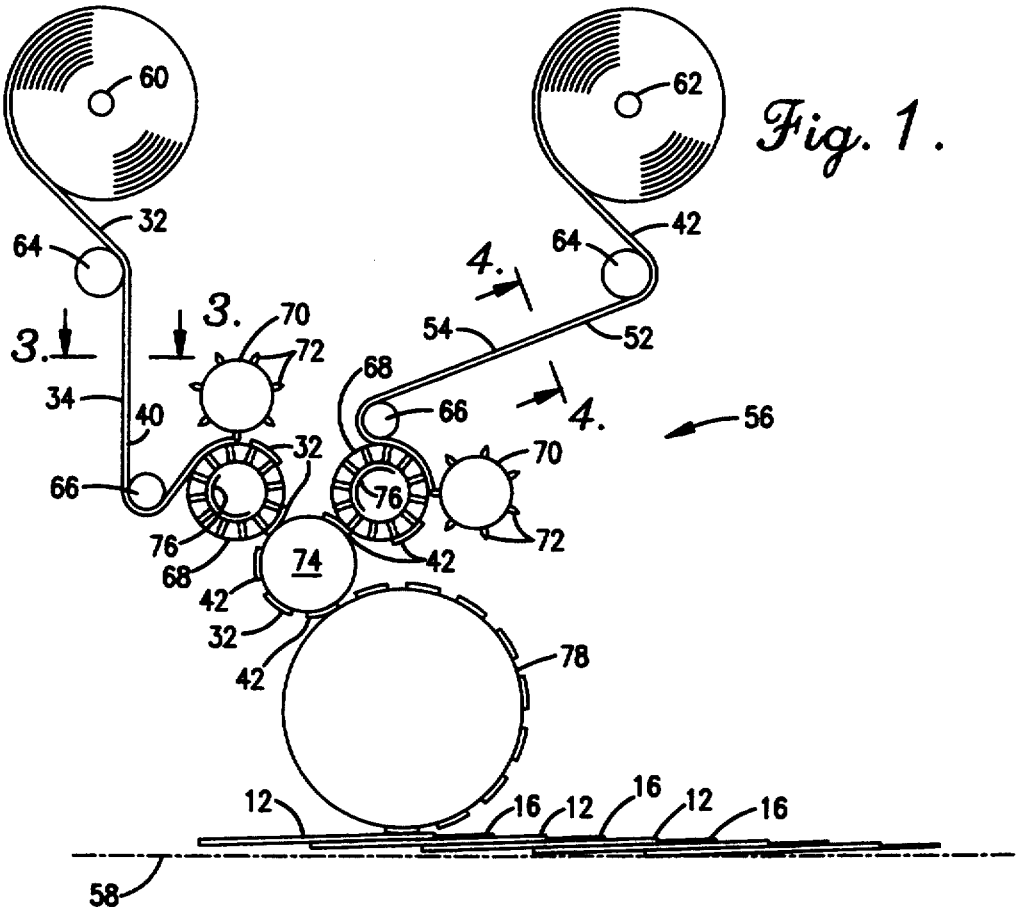
FIG. 1 is a perspective view of a completed envelope according to the present invention.

With reference to FIG. 1, a reusable adhesive envelope according to the present invention is generally designated by reference numeral 10. The envelope 10 generally consists of a pouch 12 having an opening 14 along one edge, and a top flap 16 adapted to be folded over to close the opening 14.

In particular, the envelope 10 consists of a blank folded to form the various portions of the envelope. For example, the envelope includes a front panel 18 and a back panel 20, with the back panel being formed by folded extensions of the front panel. The front and back panels are secured together about three edges. The side edges 22 are sealed by the fold lines in the envelope blank formed when creating the back panel. Similarly, a bottom edge 24 is sealed by a fold line in a bottom flap 26 adhesively secured to the back panel 20. The top flap 16 and bottom flap 26 are, like the back panel, formed from extensions of the front panel 18, as is known in the art. The top edge is defined by opening 14.

The intersection of the front panel 18 and top flap 16 will define a fold line 28, possibly scored, about which the top flap may be folded from the open position of FIG. 1 to a closed position. An interior face 30 of the top flap will be placed in contact with the back panel in this closed position, thus blocking the opening 14 to close the envelope.

While a particular envelope is shown in the drawings, various envelope sizes and configurations are known in the art and may be employed in the present invention. Additionally, for any given final configuration, various blank arrangements may be used with various folding and gluing patterns to achieve the final configuration.

Figure 3:
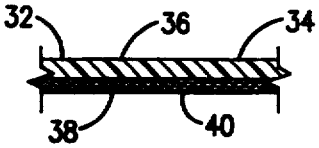
FIGS. 3 and 4 are cross-sectional views along lines 3—3 and 4—4, respectively, of FIG. 2.

It is upon the envelope that the reusable seal of the present invention is applied. This reusable seal includes at least one protective strip 32 mounted upon the exterior of the back panel 20 at a position in proximity to the opening 14. As is best shown in FIG. 3, the protective strip 32 takes the form of a strip of tape having a body 34 with upper and lower faces 36 and 38, respectively. The upper face 36 is a relatively low friction surface, and may be formed with release-type materials such as silicone or other well-known materials. A pressure sensitive adhesive layer 40 is secured to the lower face 38, and it is this adhesive layer 40 which secures the protective strip to the front panel 20 of the envelope. An unplasticized poly-vinyl chloride tape has been found to work well.

The reusable seal additionally includes at least one adhesive portion 42 mounted upon the inner face 30 of the top flap 16, with each adhesive portion 42 being substantially laterally (parallel to the fold line 28) aligned with, and substantially equally spaced from the fold line 28 in the longitudinal direction (perpendicular to the fold line), from the associated protective strip 32.

Figure 4:
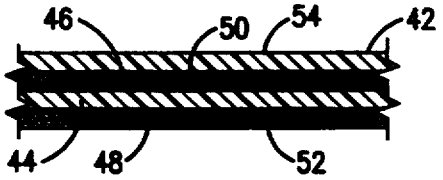

Each adhesive portion 42 is best shown in FIG. 4, and at least consists of a layer of adhesive sufficient to be secured to the flap at its lower surface, and still provide a good bond strength on its upper surface. For added strength to ease application to the envelope, it may be preferred to provide the adhesive with a substrate layer. If so, the adhesive portion may advantageously include a section of double-sided adhesive tape having a substrate 44 with upper and lower faces 46 and 48, respectively. Each of the faces 46 and 48 will include a pressure sensitive adhesive layer 50 and 52, respectively. The particular adhesives used for layers 50 and 52 may be identical, or may be different adhesives.

The adhesive portion is secured to the inner face of the top flap by the adhesive layer 52. The adhesive layer 50 is therefore uppermost in the open position of the flap. In its initial form, the adhesive portion will preferably include a removable release liner 54 mounted upon the adhesive layer 50. The release liner 54 includes a low friction release-type coating on both sides, as discussed more fully below. The size and shape of the adhesive portion will be similar to that of the protective strip 32, although the adhesive portion is preferably slightly smaller, as discussed below.

In use, the envelope will have an initial configuration as shown in FIG. 1, with the release liner 54 fully adhered to the adhesive layer 50. This allows the envelope to be easily handled for packing and shipping without adhering to adjacent envelopes. The envelope is also in the open configuration, which is typically preferred by users, and which also eliminates the need to fold the top flap into the closed position during manufacture. If desired, the top flap may be folded to the closed position prior to shipping. If this is done the release layer 54 will prevent adhesion of the top flap to the pouch, ensuring that the envelope may be easily opened by the user.

When the envelope is ready for its initial use, the user will manually remove the release liner 54, exposing the adhesive layer 50. The top flap will then be folded about fold line 28 to place the inner face 30 of the top flap in abutment with the outer face of the top flap 20. This will bring the adhesive layer 50 into contact with the protective strip 32, causing an adhesive bond between the two. As noted above, it is preferred that the adhesive portion 42 is smaller than the protective strip 32. This will ensure that the adhesive layer secures only to the protective strip, and not to the back panel directly.

With the top flap secured, the envelope may be routed to its destination. At this point the user may manually lift the top flap to the open position. This action is resisted by the various adhesive layers acting between the top flap 16, back panel 20, tape body 34 and substrate 44. To ensure that the envelope may be resealed, it is important that the adhesive bond between the adhesive layer 50 and the upper face 36 of the protective strip be the least strong among the various adhesive bonds. This will permit the adhesive layer 50 to peel away from the upper face of the protective strip without damaging the protective strip or the adhesive portion 42. As such, the envelope may be resealed and reopened many times using this same procedure.

The majority of envelopes useable with the resealable system according to the present invention are formed on well-known machinery, such as the Helios 249, available from W&D Machinery of Overland Park, Kans. This machinery begins with a roll of paper and forms the blanks, separates the blanks, and performs forming and gluing to fabricate the completed envelope, all in a single conveyor line. The reusable seal and method and apparatus according to the present invention may be employed with any of these types of envelopes and machinery, with the sole limitation being that the direction of conveyance of the envelopes during the method is perpendicular to the fold line 28. This limitation is met by many commercially available envelope forming machines, including the Helios 249 noted above. As such, the method and apparatus for forming the reusable seal according to the present invention may be incorporated into such a prior art method and device. Alternatively, the method and apparatus according to the invention for forming the reusable seal may be a separate piece of equipment.

Figure 2:
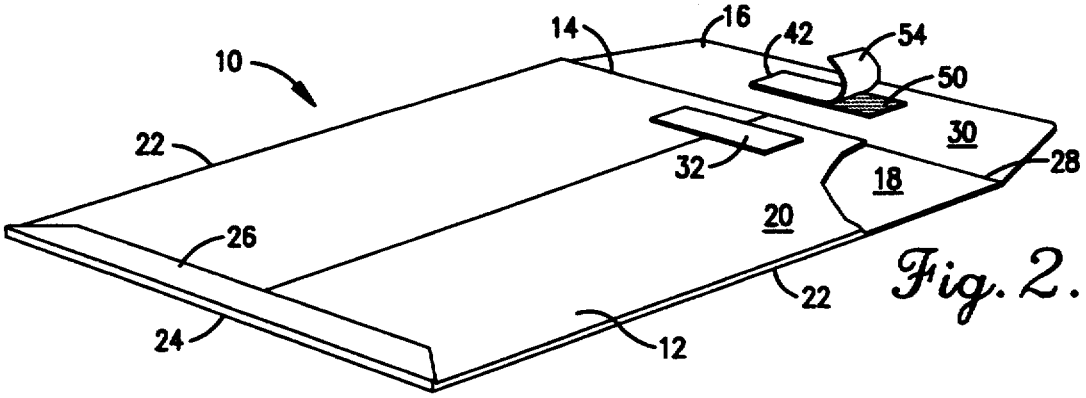
FIG. 2 is a schematic side view showing an apparatus and method for forming the envelope of FIG. 1.

With reference to FIG. 2, an apparatus for forming the reusable seal according to the present invention is generally designated by reference numeral 56. This apparatus will perform the method according to the present invention.

As noted above, the apparatus 56 may be a separate unit, or may be incorporated into a standard envelope forming apparatus. In either case there will be a conveyor means 58 upon which envelopes will be fed. The envelopes will generally be in an orientation such that they are conveyed perpendicular to the fold line 28 of the top flap, with the envelope in the open configuration, and with the interior face 30 of the top flap and back panel 20 uppermost. Beyond that, it is preferred, but not required, that the envelopes have been collated as shown in FIG. 2 such that the top edge of the top flap of each envelope is spaced slightly below the intended location for the protective strip on the next envelope in line. In other words, the envelopes are collated to a partially overlapping relation with the top flap, opening, and a section of the back panel adjacent the opening, accessible for each envelope. In general, the area of the envelope between and including the protective strip and adhesive means is all that is accessible for each envelope. This collated arrangement with fold lines perpendicular to the conveyance direction is typical in envelope forming machines, and as such the present device is very well suited to inclusion in such machines.

The apparatus 56 includes two spools 60 and 62, which respectively mount rolls of material used to form the protective strip 32 and adhesive portion 42. As noted above, the materials used to form 32 and 42 are in the form of tapes, such that the rolls of material are in the form of rolls of adhesive tapes. As shown, the rolls are formed such that the adhesive layer 40 of the protective strip 32, and the adhesive layer 52 of the adhesive portion 42, are radially inward of the roll. As such, these adhesive layers will contact the outer faces of the protective strip and the release layer 54, respectively, and thus allow easy unwinding.

Each strip of tape material from these rolls may be fed past at least one idle and/or tensioning roller 64, with this roller preferably contacting only the non-adhesive side of the tape, as is shown. Each strip is then fed past a metering roller 66. In this instance it is preferred that the metering rollers have a low friction surface, such as Teflon®, and the adhesive side of the tape contact the metering roller. This will result in a desired amount of friction between the tape and the metering roller, as discussed more fully below. Other arrangements to create the desired friction are also possible, such as contacting the release surface on the metering roller, but providing a higher friction surface and/or providing vacuum holes in the surface of the metering roller and/or providing two rollers and running the tape through their nip.

The metering rollers are rotated under power to advance the tape from the roll at a desired speed, which corresponds to the peripheral speed of the metering roller. In the embodiment shown, the metering rollers will be rotated in a counter-clockwise direction. This will be discussed more fully below.

The metering rollers are each located in proximity to an associated anvil roller 68. The anvil rollers include means for retaining the tape in contact with the anvil roller against the force of gravity. In the preferred embodiment a plurality of vacuum holes are located in their exterior, and are connected to an appropriate low pressure source. Other means, such as static electricity, may alternatively or additionally be employed. As is seen, the tapes are fed to the anvil rollers such that their non-adhesive or release sides are in contact with the anvil rollers. The anvil rollers are each rotated (typically at a constant, common speed), which of course results in a peripheral speed of the rollers. In the embodiment shown, this rotation is in the clockwise direction. As may be envisioned, the suction generated by the vacuum holes in the exterior of the anvil rollers will cause each tape to be "adhered" to the associated roller 68, and drawn about its periphery in the direction of rotation of the anvil roller.

Each anvil roller 68 has an associated cutter roller 70, with each cutter roller having one or more blades 72 extending from its periphery and adapted to coact with the anvil roller to sever the associated tape. The cutter rollers are rotated in a direction opposite to that of the associated anvil roller, such that in the embodiment shown the cutter rollers rotate counter-clockwise. The blades 72 of the cutter rollers will sever the tapes to create strips of the tapes corresponding to the final size of the protective strip 32 and adhesive portion 42.

An important feature of the present invention is the relative adhesion to the tapes generated by the metering rollers and the anvil rollers. In particular, the anvil rollers must have sufficient adhesion to maintain the severed tape strips in position upon the periphery of the anvil roller against the force of gravity and centrifugal force, as shown in FIG. 2. However, the metering rollers must have sufficient adhesion to the tapes to ensure that the tapes advance only with rotation of the metering roller, to maintain the speed of the tape equal to the peripheral speed of the metering roller. These requirements are combined with different peripheral speeds for the metering and anvil rollers to permit alternating placement of the protective strips 32 and adhesive portions 42.

In particular, the anvil roller has a peripheral speed which is greater than that of the metering roller. Since the tape will only advance with the metering roller, the relatively slower moving free end of the tape will slide with respect to the faster peripheral surface of the anvil roller, but will be held thereto by the vacuum holes. Although the tape slides on the anvil roller, it is advanced by the metering roller. As such, the free end will advance about the periphery of the anvil roller, though at a rate less than the peripheral speed of the anvil roller.

The cutter rollers are driven at an appropriate speed to cause the desired length of each tape to be advanced over the anvil roller between cuts. It may be preferable for the peripheral speed of the tips of the cutting blades to be greater than the speed of the tape for proper cutting of the adhesive, and it may be desirable to have this blade peripheral speed be equal to that of the anvil rollers.

Once the tape strip has been severed by the cutting blade, it is not held back by the metering roller, and advances with the anvil roller at its relatively higher peripheral speed. This results in the tape strip moving away from the free end of the remainder of the tape. This process is then repeated, resulting in another tape strip advancing with the anvil roller, such that the net result is tape strips being formed at spaced locations about the periphery of the anvil rollers, with the adhesive sides radially outward.

These differences in peripheral speed or the rollers may of course be brought about in different ways. For example, the rollers may be rotated at identical rates, but have different radii. Alternatively, the roller radii may be identical, but be rotated at different rates.

It is of course apparent that the same holds true for the outer ends of the cutting blades 72. Also, it should be clear that the number of cutting blades may vary depending upon the desired tape size, final distance between tapes, collated spacing of the envelopes, etc.

It is possible to employ the anvil rollers to place the tape strips into position upon the envelopes. To do this the anvil rollers must be spaced, in the direction of envelope conveyance, a distance equal to that between the final placement of the protective strip and adhesive portion for a single envelope. Additionally, the anvil rollers must be driven at a speed such that the timing between tape strips equals the timing between envelopes. The anvil rollers would then press the protective strip and adhesive portion upon each envelope at approximately the same time, using the conveyor as a backstop against envelope movement. While this arrangement is possible, in practice it provides little ability to adjust the apparatus or method for envelopes having different sizes and seal placements. As such, the following is preferred.

As is seen in FIG. 2, the process of forming spaced tape strips is being carried out by both anvil rollers. The anvil rollers are both in close proximity to a transfer roller 74, having a peripheral speed substantially equal to that of the anvil rollers, though in the opposite direction. The spacing between the anvil and transfer rollers is such that the tape strips from each anvil roller are transferred to the transfer roller.

As may be envisioned, the tape strips will be placed on the transfer roller with the adhesive sides radially inward, such that the tape strips will inherently adhere to the transfer roller. This may be sufficient to ensure transfer of the tape strips. However, it may be desired to place suction barriers 76 within the anvil rollers to eliminate the suction through the vacuum holes in the anvil roller over a radial arc beginning with the contact point with the transfer roller. Alternatively, positive pressure may be employed to blow air out of the vacuum holes at the transfer point. These methods will eliminate the adhesion between the tape strips and the anvil roller over this arc. It may also be desired to provide the transfer roller with a low friction surface, such as Teflon ®, and/or provide the transfer roller with vacuum holes over its periphery in a manner similar to the anvil rollers.

As noted, the tape strips are transferred to the transfer roller from the anvil rollers. Since these rollers have similar peripheral speeds, the peripherally spaced orientation of the tape strips will be maintained on the transfer roller. Additionally, the timing of the cutting is alternated, such that the tape strips for the protective strip 32 are placed intermediate the tape strips for the adhesive portion 42. In other words, the two different tape strips are alternated in a repeating pattern on the periphery of the transfer roller.

At this point the tape strips are transferred to a placing roller 78. The roller 78 is in proximity to the transfer roller, and is driven in the opposite direction, such that the tape strips are transferred from the transfer roller to the placing roller. This transfer of course is facilitated by the transfer and placing rollers having a substantially equal peripheral speed. As may be seen, the tape strips will have their adhesive sides radially outward after transfer to the placing roller, and as such the placing roller will include vacuum holes about its peripheral surface, or other means, to maintain the tape strips in place.

To aid in the transfer, the transfer roller may be provided with an appropriate suction barrier within the transfer roller to eliminate the suction through the vacuum holes over a radial arc beginning with the contact point with the placing roller, and ending with the contact point with the anvil rollers. This will eliminate the vacuum adhesion between the tape strips and the transfer roller over this arc, in a manner similar to the anvil rollers. There may still be some adhesion to the transfer roller due to the adhesive layers, but use of a low friction surface on the transfer roller and vacuum holes on the placing roller should ensure proper transfer. If needed, positive pressure could be used to blow air from the holes in the transfer roller to positively aid transfer.

The tape strips will at this point be in the alternating, peripherally spaced relationship about the periphery of the placing roller, with their adhesive sides radially outward. The placing roller is also located in proximity to the conveyor means 58, such that the placing roller rolls over the envelopes. The tape strip spacings, placing roller speed, and envelope speed are all timed such that the tape strips are pressed upon the envelopes at the desired location, with the protective strips 32 being placed on the front panel, and the adhesive portions 42 being placed on the top flap. The adhesive on the tape strips will assist in the transfer from the placing roller to the envelope, although it may be desired to employ a suction barrier within the placing roller to eliminate the suction through the vacuum hole at the transfer point, or positive pressure, in a manner similar to those discussed above.

As may be envisioned, this arrangement permits the formation of reusable adhesive envelopes at a relatively high speed. The various rollers may all be driven strictly by rotation, eliminating the problems associated with indexing. Additionally, the alternating relationship of the tape strips allows the two different materials to be applied to the envelopes during conveyance in a direction perpendicular to the fold line 28. This eliminates the need to perform separate steps to feed the envelopes parallel to the fold line to apply the tape strips.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense. For example, the protective strip may be located upon the flap, while the adhesive means is located on the back panel.

What is claimed is:

1. An apparatus for making envelopes adhesively reusable, the envelopes including a pouch defined by front and rear panels, the pouch including an opening, and a flap formed as an extension of the rear panel adjacent the opening, the flap being foldable about a fold line from an open position in which the opening is accessible and the front panel is uncovered to a closed position in which the flap blocks the opening and overlies a portion of the front panel, the flap being in the open position, said apparatus comprising:

a first spool for mounting a reel of protective strip tape;

a second spool for mounting a reel of double sided tape having a release liner on one side thereof;

a metering roller associated with each said spool to receive the tape therefrom, each said metering roller having a first coefficient of friction with the associated tape, said metering rollers being driven with a first peripheral velocities;

an anvil roller associated with each said metering roller to receive the tape therefrom, each said metering roller having a second coefficient of friction with the associated tape, said anvil rollers being driven with a second peripheral velocities;

a cutter roller associated with each said anvil roller and adapted to sever tape segments from the tape on said associated anvil roller, said first and second coefficients of friction being related such that the tape segments will be adhered to the anvil roller, yet the free end of the tape may slide with respect to the anvil roller, and the tape will be advanced only by said metering rollers, said first peripheral velocities being less that said second peripheral velocities such that the tape segments are formed at spaced peripheral locations on said anvil rollers; and conveyor means for supporting and advancing the envelopes in a direction perpendicular to the fold line, whereby the tape segments from each of the tapes may be adhered to each of the envelopes.

2. An apparatus as in claim 1, further comprising a transfer roller associated with said anvil rollers and located and adapted to receive the tape segments from said anvil rollers, said cutter rollers being timed such that the tape segments from the two anvil rollers are placed on said transfer roller in spaced alternating arrangement about the periphery of said transfer roller, and further comprising a placing roller located and adapted to receive the tape segments from said transfer roller, said placing roller being mounted adjacent said conveyor means to cause the tape segment to be removed from the placing roller and adhered to the envelopes.

3. An apparatus as in claim 2, wherein said anvil rollers include a plurality of vacuum holes opening onto their peripheries, said vacuum holes being connected to a source of reduced pressure.

4. An apparatus as in claim 3, wherein said transfer roller includes a low friction coating.

5. An apparatus as in claim 4, wherein said metering rollers rotate in a direction opposite to that of said anvil rollers.

* * * * *